United States Patent [19]

Van Bryant, Jr.

[11] 4,357,020

[45] Nov. 2, 1982

[54] CONVERTIBLE RECREATIONAL DEVICE

[75] Inventor: Edward Van Bryant, Jr., Richmond, Va.

[73] Assignee: M & B Headwear Co., Inc., Richmond, Va.

[21] Appl. No.: 197,847

[22] Filed: Oct. 17, 1980

[51] Int. Cl.[3] ..... A63B 65/00; A63H 33/18; A42B 1/04; A45C 9/00

[52] U.S. Cl. ..... 273/424; 2/195; 2/209.1; 224/151

[58] Field of Search ..... 273/424; 46/74 D; 2/194–197, 209.1, 200; 224/151

[56] References Cited

U.S. PATENT DOCUMENTS

| | | | |
|---|---|---|---|
| 430,003 | 6/1890 | De Lacy | 2/195 X |
| 573,192 | 12/1896 | Worden | 2/197 |
| 911,432 | 2/1909 | Pachner | 2/195 |
| 1,269,594 | 6/1918 | Geraghty | 2/196 |
| 1,660,889 | 2/1928 | Saul | 273/424 X |
| 2,495,041 | 1/1950 | Weiss | 2/209.1 X |
| 4,115,946 | 9/1978 | Vukmirovich | 273/424 X |
| 4,290,226 | 9/1981 | Stauffer | 46/74 D |

*Primary Examiner*—Paul E. Shapiro
*Attorney, Agent, or Firm*—Allan Redrow

[57] ABSTRACT

An article is shown that is convertible to various uses including in one form as a hat, in another as a handbag and lastly as a whirling disc-like hurling means. The body of the article is adapted to be altered to place it in a form useful for its several respective uses and thus is adapted to be easily changed from an extended condition to a rolled up compact arrangement to suit the use to which the article is to be put.

1 Claim, 4 Drawing Figures

CONVERTIBLE RECREATIONAL DEVICE

PRIOR ART

Variations of the popular whirling disc device known as the Frisbee sold by the Whamo Company, have been proposed such as shown in the U.S. Pat. Nos. 3,545,760 to Wilson, Dec. 8, 1970; 3,571,811 to Wilson, May 23, 1971 and 4,115,946 to Vukmirovich, Sept. 26, 1978. These disclosures all suggest a dual purpose device that may be used as a whirling disc adapted to be thrown into the air or used to cover the head.

The Wilson patents show a beanie-type hat having a disc for throwing, removably attached thereto and another hat made of stiff blow-molded plastic or the like that is held on the head to form a hat by means of a flexible strap that passes under the chin. In the beanie device, the disc is a conventional rigid Frisbee structure with an added connector means at its center for attaching the Frisbee to the beanie on which it is carried. The second Wilson hat, being a stiff, rigid Frisbee, requires an added band to hold the exactly circular device on the head to imitate a hat. It is described as being hollow to provide heat insulation.

The Vukmirovich patent shows a flexible fabric discus-shaped toy having a weighted hem for use as a hat or for whirling throwing purposes. This patent suggests a toy that may be crumpled to fit into the pocket or it may be fitted to the head to form a beanie-like hat.

BRIEF DESCRIPTION OF THIS INVENTION

The triple purpose article to be described more fully below, that forms the subject of this disclosure, includes a flexible cylindrical body having an end wall, a side wall and an open end. The open end is adapted to be permanently attached to a flexible rim element of a size to comfortably form the band of a hat element to be fitted onto the head. The side wall of the body may be either rolled up onto the flexible rim so that it may be thrown through the air with a whirling action or used as a hat or the article may be used with the side wall in its unrolled condition to serve as a carry-all with the flexible rim at the mouth of the bag functioning as a convenient closure means and carrying handle.

When the side wall is rolled up onto the generally ring-like flexible rim, the open end of the cylindrical body is drawn taut immediately across rim element to form a disc-like member that may be tossed about with a whirling action in the manner of using a Frisbee. The rim has sufficient weight and character to maintain the whirling action and the fabric stretched over the rim gives the device the desired aerodynamic qualities needed for this use. Also, in the rolled up condition, the rim and fabric can be used as a beanie-type head covering. Further, when the side wall is partially or entirely unrolled from the rim element, the flexible body, together with the rim, may be manipulated to form the structure into a very different type of head covering such as a stylish cap-like hat means having a very rakish appearance. In yet another adaptation of this article to a third recreational use, the body element may be completely unrolled from the rim to form a bag-like container for the storage of articles. The rim that surrounds the open end of such a carry-all device serves the function of a collapsible closure for the open mouth of the bag and as a handle means to hold the contents neatly enclosed within the body when the rim is collapsed in the grip of the hand of the person carrying the bag.

It is therefore an object of this invention to show an article that may be manipulated to provide a recreational device that may be adapted to any one of a number of uses.

Another object of the invention is to provide a flexible structure that may be used as a carry-all or as a head covering or as a whirling disc device that may be thrown into the air.

Another object of the invention is to provide a flexible article that may be easily converted for use either as a carry-all or as a hat or as a disc-like device adapted to be thrown into the air with a whirling action.

Another object of the invention is to provide a flexible carry-all or disc-like means that may be easily converted to form a rakish hat design.

Still another object is to provide a flexible compact disc-like structure that may be converted into a flexible sealable carry-all use.

Other objects will appear from the detailed description below.

THE DRAWINGS

DETAILED DESCRIPTION

Figure 1:
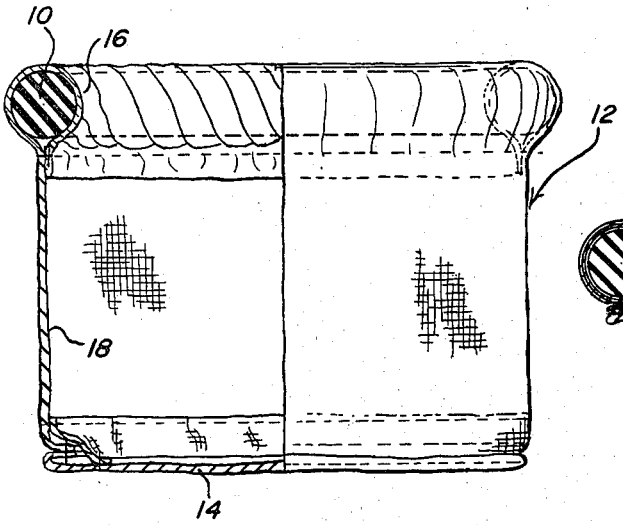
FIG. 1 is a sectional view through the unrolled article.

The convertible article of manufacture here shown is well adapted for recreation use and includes a flexible ring-shaped rim and support element 10 onto which one end of a cylindrical body 12 is fixed. The body is an elongated cylinder having a side wall and being closed at one end by a wall 14. The body is preferably formed of a woven fabric material, the parts of which may be stitched together, the end of the cylinder opposite from the end wall 14 being open and this end of the cylinder has a hem 16 for surrounding rim member 10 and affixing the cylindrical body to the rim. The cylindrical body has an elongated side wall 18 for enclosing the space between the open and closed ends of the body.

The ring-shaped element 10 on which the body is mounted is made of a soft flexible material that has sufficient integrity to normally hold a circular shape, but which may be easily deformed to fit around a person's head or squeezed closed in a person's grip. For this purpose, the rim may be made of a cured rubberlike natural or synthetic resin either solid or foamed and has a reasonable weight for making the article servicable as a known type of whirling disc device, all as will appear more fully below.

Figure 2:
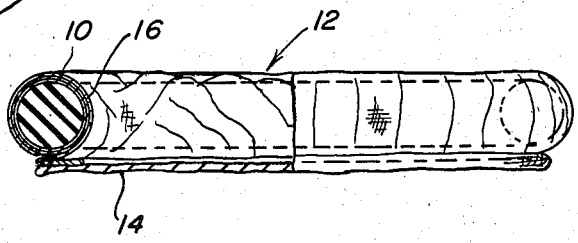
FIG. 2 is a sectional view through the rolled-up article.
Figure 3:
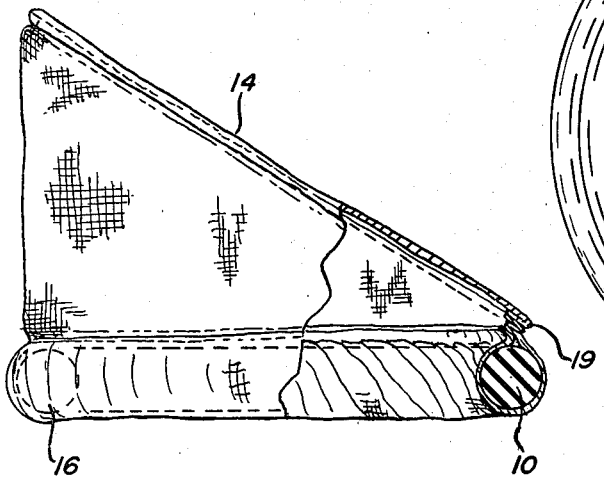
FIG. 3 is a view of the unrolled article used in the form of a rakish cap design, partly broken away.
Figure 4:
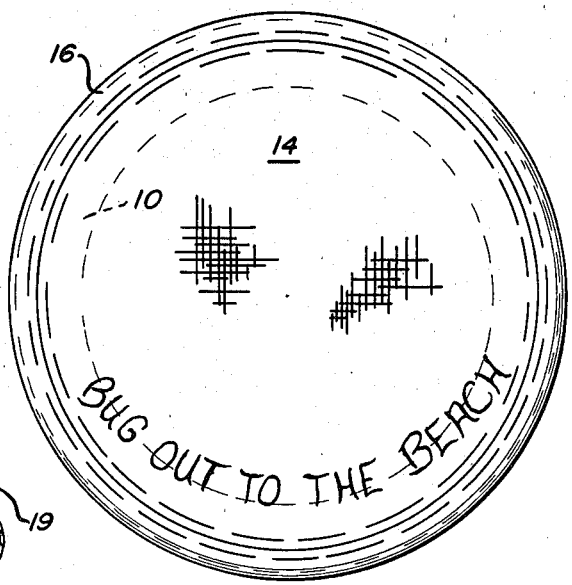
FIG. 4 is a top view of the article.

As shown in FIG. 3, the cylindrical body is shown with the wall 18 unrolled and extending upwardly on one side from the rim 10. If one side of the cylindrical wall 18 is collapsed, as indicated by reference 19, while the other side is left extended, the bottom 14 of the body is then disposed at a relatively steep angle to the plane of the rim and a rakish cap shape is formed. The article may be fitted to a person's head for decorative effect and to protect the head of a person on the beach, for example, from the sun's rays. If a less extreme design of a cap is desired, the side wall 18 may be partly rolled up on the rim so that when the one portion of the side wall is collapsed, the angle of the bottom relative to the rim is less steep, and some might decide, a more conservative cap design is provided. If the side wall is rolled up entirely around the rim, as shown in FIG. 2, the article can still be worn as a tam-o-shanter type of hat.

When the cylindrical wall 18 has been completely rolled up on the rim, as shown in FIG. 2, the bottom 14 is stretched more or less taut across the open center of the ring-shaped rim. The article so arranged may be used not only as a head covering but also may be used as a whirling disc-like means that may be tossed into the air to sail from one person to another for recreational purposes.

On the other hand, when the cylindrical element is left unrolled, the open end may be disposed upwardly to form a beach bag or carry-all means. If a collection of small articles to be used at a picnic or on the beach, for example, are placed within the cylindrical body, the flexible rim may be easily squeezed closed to provide a handle means for closing the open end to provide a relatively secure container device.

It should be noted that the body element 12 may be made of any reasonably flexible plastic or other sheet material that may be secured to rim 10. Preferably the body material can breathe as does a woven fabric to provide a comfortable cap means, but for a novelty effect, this is not a critical factor. The body walls and especially the end wall 14 can be used as panel means for the display of printed slogans or advertising messages. While preferably a cylindrical body is provided, within limits, the side wall 18 may be other than a cylindrical shape; it need be only a structure that can be conveniently rolled up onto rim 10 as depicted in FIG. 2. The closed end 14 has been described above as preferably being made of a flexible fabric material but it is suggested that it might be made of a stiff plastic, paper or even light metal disc that can retain a more rigid shape. The use of such a closed end would provide a structure that could be designed for a more unusual cap appearance or for an improved aero-dynamic characteristic when the device is used as a whirling disc.

From the description above, it is apparent that an easily convertible article is provided which may be used as a cap or as a carry-all or as a whirling disc recreational device. The above covers the preferred form of the construction. It is possible that modifications thereof may occur to those skilled in the art that will fall within the scope of the following claims.

I claim:

1. A convertible article of manufacture serving the purpose of a recreational device for play, dress and as a carry-all, comprising a flexible rim element, a body portion permanently attached to said rim, said body portion being made of a flexible material and being adapted to be rolled up on and unrolled from said rim element, said rim element being generally circular in shape and forming a perimeter around a circle of a diameter to comfortably fit around the head of a person who uses the article, said body portion being an elongated substantially cylindrical wall with two ends, one of said ends being open and attached to said rim, the other end of said body being closed with generally flat circular member, said circular member having a diameter substantially equal to the diameter of said rim, said elongated substantially cylindrical wall of said body having a length equal to at least one-half the diameter of said rim whereby all of said substantially cylindrical wall can be rolled up on said rim to position said circular end member of the body adjacent said rim in a manner to span the entire circular area defined by the perimeter of said rim to form a circular disc-like whirling device.

* * * * *